US005196766A

United States Patent [19]

Beggs

[11] Patent Number: 5,196,766

[45] Date of Patent: Mar. 23, 1993

[54] DISCHARGE CIRCUIT FOR FLASH LAMPS INCLUDING A NON-REACTIVE CURRENT SHUNT

[76] Inventor: William C. Beggs, 4110 Shawnee La., NE., Atlanta, Ga. 30319

[21] Appl. No.: 754,834

[22] Filed: Sep. 4, 1991

[51] Int. Cl.[5] ..... H05B 37/00

[52] U.S. Cl. ..... 315/241 R; 315/241 S; 315/241 P; 315/200 A; 354/145.1

[58] Field of Search ..... 315/241 R, 241 S, 241 P, 315/234, 237, 349, 200 A; 354/145.1, 413, 416, 417; 320/1; 363/74

[56] References Cited

U.S. PATENT DOCUMENTS 3,115,594 12/1963 Mallory ..... 315/241 R
3,339,108 8/1967 Holtje ..... 315/241 R
3,375,403 3/1968 Flieder ..... 315/241 P

*Primary Examiner*—Paul M. Dzierzynski
*Assistant Examiner*—Michael B. Shingleton
*Attorney, Agent, or Firm*—Lee, Mann, Smith, McWilliams, Sweeney & Ohlson

[57] ABSTRACT

A discharge circuit for and method of operating a flashlamp are disclosed in which the flashlamp is reliably operated repetitively while reducing current surges from the electrical power source. A switch means is provided for shunting recharge energy through a non-reactive means around an energy storage means for the flashlamp. The rate of recharging the energy storage means is reduced at the beginning of recharging below the rate which would allow the flashlamp to conduct before intentional triggering of a flash.

5 Claims, 2 Drawing Sheets

DISCHARGE CIRCUIT FOR FLASH LAMPS INCLUDING A NON-REACTIVE CURRENT SHUNT

This invention relates to an apparatus and a method for reliably operating repetitive flashlamps while reducing current surges from the electrical power source. A shunt switch and an impedance control the rate-of-rise of the recharging voltage after each flash.

Flashlamps used for visual signaling typically flash once or twice each second to rapidly convey information while avoiding blurring in the human eye occurring above twenty times each second, or while avoiding epileptic responses centered around eight flashes each second (march music, etc.). These flashlamps typically conduct 500 amperes to 50 amperes of electrical current during the flash duration from 0.002 seconds to 0.008 seconds (2 milliseconds to 8 milliseconds). These flashlamps are spark gaps with some gas held around the gap and physically arranged so that some useful light radiation may be obtained from the conduction of electrical current through the gas in the gap.

Repetitive flashlamps are typically operated from an electrical power source located from several feet to several miles away, and requiring a protected electrical cable system from the power source. The cable system has some resistance, inductance, and capacity and is protected by routing on poles or underground and costs money. Energy losses in the cable system are primarily $I^2RT$=Joules=Watts×seconds, where I is current flow through the cable in amperes, R is the electrical resistance in the cable in ohms, and T is the time of that current flow. If twice as much current flowed through the cable for half the time, energy out of the cable would be the same but energy lost in the cable would double. J32 $I^2RT$, (2I) $^2R$ 0.5T=4×0.5 J=2J. To fully utilize the capabilities of the cable system to maximize the useful energy out for each dollar invested one strives for a fixed amount of current to flow continuously without surges.

Continuously burning lights are often supplied by the same cable system that supplies the flashlamps. Airports typically have a need for flashlamps at the end of a runway, located thousands of feet away from any source of electrical power other than the nearby cable supplying the electric lights around the edges of the runway. That edge lighting system is usually a constant RMS current system operating the hundreds of 30 or 45 watt edge lamps electrically in series for controlled illumination from a constant RMS current regulator which has a typical response time, to correct its current output, of 1.5 seconds, therefore current surges of 0.5 second or 1.0 second repetition cannot be controlled by the regulator and are to be avoided in the design of the flashlamp systems.

Flashlamps using more than 25 joules per flash are often flashed simultaneously on a runway, drawing more than 50 joules per flash. For a flash duration of 0.005 seconds: 50J0.005sec=10,000 watts is the power flowing during the flash. A battery pack with a short circuit current of 6.6 amperes would need an open circuit voltage of 3,000 volts to supply the energy while losing no more than one half the energy within the battery pack itself. The internal impedance of the battery pack at Z=3,000 v/6.6 A=450 ohms was too high. Therefore capacitors were used by photographers (Harold Edgerton, et al.) to supply the flashlamp within 0.005 seconds. The capacitors were then recharged, during the time between flashes, at much lower current from the power source. Capacitors of lowest internal resistance begin to become efficient for storing energy for a given capacitor size as the voltage in them exceeds 2 kv. Many flashlamps were developed to use energy stored in 2 kv capacitors in "capacitor discharge" systems. 10,000 watts/2 kv=500 amperes, 250 amperes through each flashlamp. They used gas in transparent tubing of I.D. sufficient to allow 250 amperes to flow and long enough to tubing is often folded or coiled to form part of a more compact optical system having acceptable light beam control. Where capacitors of higher internal resistance are applicable, electrolytic capacitors of 450 volt or 300 volt ratings have been used either singly or in series and/or in parallel.

The capacitor voltage of 1 kv or 2 kv requires a 1 kv or 2 kv open switch function in the discharge circuit including the lamp to allow the capacitor to be charged from the electrical energy source while the flashlamp is not conducting. The 1 kv or 2 kv switch function must then close and conduct 100 to 500 amperes during the flash. While the switch function can be physically separate from the lamp which produces light, it has been most economical to combine the switch function and the lamp function in one "flashlamp".

The conductivity of the flashlamp is defined as current divided by voltage. Nonconductive-before-the-flash defines a current level of essentially zero at a voltage level on the high current electrodes in the gap below that voltage level which would start conduction. The gap with the nonconductive-before-the-flash gas is made partially conductive by ionizing some of the gas with 12 kilovolts to 20 kilovolts briefly applied (typically for 3 microseconds). Other means of ionizing the gas such as with lasers, X-rays, radio frequency energy have also been used.

In order to function as an open switch the flashlamp gas must be deionized enough after the flash so that conduction through the gas does not increase as the discharged capacitor across the flashlamp has its voltage increased in preparation for the next discharge. The gas decreases conducting at the end of the flash when the discharging capacitor voltage moves below 100 volts, ±50% approximately, because the gas is losing energy faster than the lowering capacitor voltage can replace that energy. When the gas cools more, it deionizes sufficiently so that the voltage available at the capacitor will not support reionization and all conduction ceases. The gas continues to cool making any reionization require higher and higher voltage to reheat the gas.

There are various methods to recharge the capacitance fast enough to be ready for the next discharge. Where the lamp is the discharging switch all of these methods must avoid increasing the capacitance voltage faster than the cooling of the gas in the lamp. Various flashlamp geometrics and materials will cool differently in differing equipment, and differing equipment offerings will recharge their capacitance at differing rates-of-change of voltage. As flash energies increased, lamps had to be more precisely matched to equipment. Cost of this precision matching has increased initial system costs and has made generalized maintenance and generalized lamp replacement essentially impossible.

To operate flashlamps reliably from constant current systems and from emergency power sources, all having typical response-to-load-variations-times of longer than 1 second, and from 300 feet or longer cabling distance from electrical power sources, current must be drawn constantly without surges on or off. After each flash the lamp gas must be allowed to continue to cool, for typically 10 milliseconds, before voltage across the lamp starts increasing. A switch means cooperating with the flashlamp discharging circuit shunts all or part of the limited power source energy to draw current constantly from that power source and also to prevent recharging the capacitor that is across the flashlamp for enough time to allow the worst case generalized flashlamp to cooperate with the worst case generalized equipment so that flashlamp system ownership costs can be significantly reduced.

OBJECT OF THE INVENTION

It is an object of the present invention to provide an improved recharging means for repetitively flashed flashlamp systems.

It is another object of the present invention to provide a continuous loading on the power source in a repetitive flashing flashlamp system.

It is another object of the present invention to provide a system to allow the use of flashlamps of widely varying characteristics in higher powered flashlamp systems flashing repetitively.

It is another object of the present invention to provide a circuit which permits a more rapid recharge of the energy storage device in flashlamp systems which use the flashlamp as the discharge switch.

It is another object of the present invention to provide a circuit which permits higher energy flashes from the flash tube where the flash tube is also used as the discharge switch.

It is another object of the present invention to provide additional time for the gas in the flash tube to recover its non-conducting properties.

BRIEF DESCRIPTION OF THE DRAWINGS

For a complete understanding of this invention, reference should be made to the accompanying drawings in which.

DETAILED DESCRIPTION OF THE PREFERRED EMBODIMENT

Figure 1:
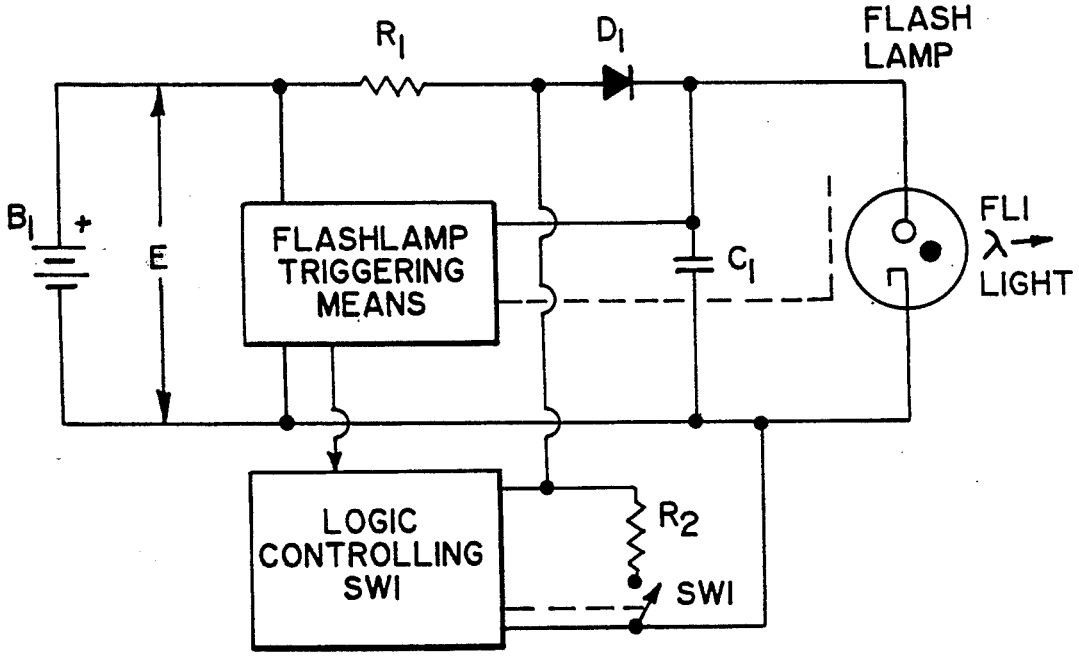
FIG. 1 is an embodiment of the circuit of this invention utilizing a direct current source.

Turning now to FIG. 1, SW1 ideally closes at the end of the flash and shunts any current through R1 from B1 around the flashlamp FL1 and around the discharged capacitance C1. This prevents voltage from rising across capacitance C1 and flashlamp FL1, so that the gas in flashlamp FL1 will continue to cool. Where B1 voltage is E=300 v and C1 is 1,000 microfarads and a flash of 0.005 second occurs every 0.5 seconds, five time constants of R1TC=R1X. C1 will allow C1 to charge to 95% of E in 0.5 seconds. 5 R1 C1=0.5 seconds, $R1=0.5/(5\times1{,}000\times10^{-6})$, R1= 1,000,000/10,000 ohms=100 ohms. If the voltage on the flashlamp-discharged C1 is 50 volts then the maximum current through R1 is (300−50)/100=2.5 Amp. R2 maximum resistance is then 50 v/2.5 A=20 ohms. If SW1 is closed before the end of the flash without diode D1 in place R2 would discharge C1 in $20\times0.001=0.02$ seconds. 0.02 seconds is comparable to the 0.005 second flash discharge time and this discharge of C1 through R2. is prevented by using Diode D1.

Using Diode D1 maintains system efficiency and makes the timing of closing Sw1 much less critical. By closing SW1 when triggering flashlamp FL1 for a 0.005 second duration flash and keeping SW1 closed for 16 milliseconds every 0.5 seconds (=500 milliseconds), only 3% of the input energy is shunted. Even this can be improved slightly by slightly increasing the resistance of R2 in concert with the worst case characteristics of gas cooling in FL1 so that the voltage will initially rise across C1 more slowly than that which would promote reconduction in the cooling FL1. The controller can sense the voltage change on C1 to control without trigger input.

SW1 must have a voltage rating of the highest voltage on the capacitor and a current rating only equal to the recharge current which makes this switch economically attractive. Two IGBTs (Insulated Gate Bipolar Transistors) in series can readily switch 2,500 volts at 3 amperes for less cost than replacing four non-operating flashlamps.

The impedances as shown in FIG. 1, may be combinations of resistors, capacitors, inductors, semiconductors and any other linear or nonlinear impedances in order to accomplish the shunt limiting described here and it is readily understood that any method to achieve this shunt limiting is within the spirit of these claims.

Figure 2:
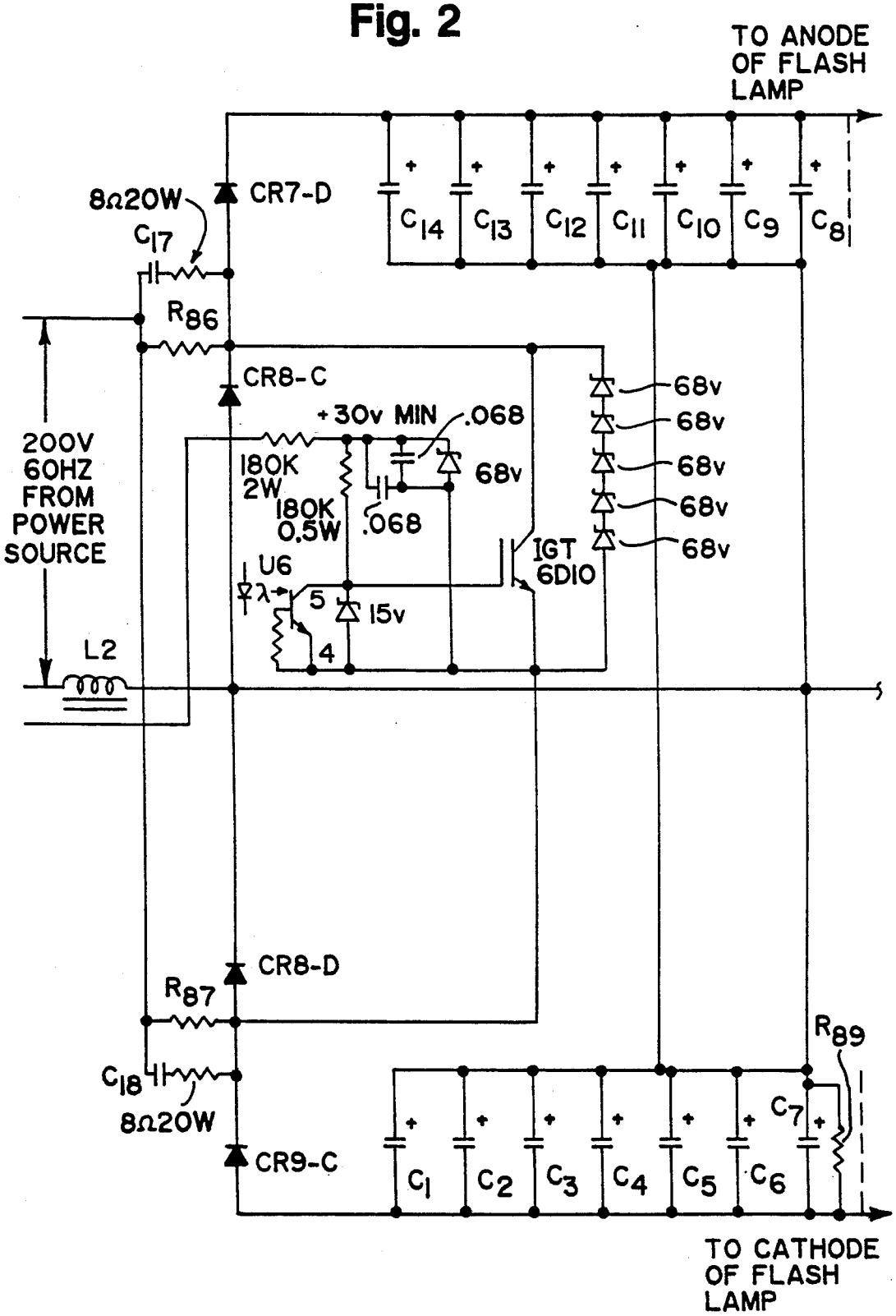
FIG. 2 is an embodiment of this invention utilizing an alternating current source.

Turning now to FIG. 2, the function performed by SW1 in FIG. 1 is now performed by the transistor IGT 6D10. The transistor is protected from overvoltage by 5 each 68 volt 1 watt zener diodes in series across the transistor. U6 optiosolator from the trigger and overvoltage logic does not conduct line 5 to line 4 during trigger pulse length of 33 milliseconds or during overvoltage of C1–C7 or C8–C14 unclamping the gate of the IGBT IGT 6D10 allowing the IGBT to shunt the recharging energy for the energy storage capacitors C1–C7 and C8–C14, preventing their recharge from the 200 volt 60 Hertz source, limited by the impedances of C17 and C18 and the two 8 ohm 20 W resistors.

In both FIG. 1 and FIG. 2 the shunt circuit comprises the switch means, a switch controlling means to have the switch closed at the beginning of the time for recharging the energy storage device and to have the switch opened before the end of the time for recharging the energy storage device, a second impedance means to limit the maximum amount of current through said switch means to avoid damaging the switch means and to allow enough current to pass through the switch means around the discharge circuit so that the rate of recharging of the energy storage device is reduced at the beginning of recharging below that rate which would allow the flashlamp to conduct before intentional triggering. R2 in FIG. 1 limits the current through the switch to a safe value for the switch selected to perform the function of SW1.

What is claimed is:

1. A discharge circuit comprising a flashlamp, a triggering means for making the gas in the flashlamp conductive, an energy storage means for discharging stored energy into the flashlamp when the flashlamp is triggered, an electrical power source, and a recharge circuit associated with the electrical power source including, a first impedance means to restrict the flow of energy from the electrical power source into the energy storage means, and a switch means for shunting recharge energy through a non-reactive means around the energy storage means so that the rate of recharging of the energy storage means is reduced at the beginning of recharging below that rate which would allow the flashlamp to conduct before intentional triggering.

2. The combination of claim 1 to which a diode is added to avoid the discharging of the energy storage means when the switch means is closed.

3. In combination, an electrical power source, a flashlamp discharge circuit means including a flashlamp and an energy storage means, recharge circuit means for charging said energy storage means, and switch means cooperating with said recharge circuit means for shunting the output of the recharge circuit means through non-reactive means to initially retard the recharging of the energy storage means.

4. The method of operating a flashlamp system which includes a flashlamp discharge circuit incorporating a flashlamp, an energy storage means for the flashlamp circuit, and a recharge circuit for the energy storage means comprising, discharging energy from the energy storage means into the flashlamp to produce a flash, preventing recharging of the energy storage means by directing a switch means cooperating with the flashlamp discharge circuit and the recharge circuit to shunt recharging current through current limiting means for retaining loading on the electrical power source and reducing surges on said source, continuing shunting while allowing the flashlamp to cool to prevent conduction through the flashlamp, and operating the switch means to direct recharging current from the power source into the recharge circuit for the energy storage means after the flashlamp has cooled sufficiently to allow recharging of the energy storage means to begin in preparation for the next desired flash.

5. The method of operating of flashlamp system which includes a flashlamp discharge circuit incorporating a flashlamp, an energy storage means for the flashlamp circuit, and a recharge circuit for the energy storage means, comprising discharging the energy storage means into the flashlamp discharge circuit, shunting recharging current for the energy storage means from a power source around the energy storage means through a non-reactive means until the flashlamp has cooled sufficiently to prevent conduction through the flashlamp until the next desired flash, and recharging the energy storage means from the recharge circuit.

* * * * *